US010213085B2

(12) United States Patent
Vallejo Noriega et al.

(10) Patent No.: US 10,213,085 B2
(45) **Date of Patent: *Feb. 26, 2019**

(54) DISHWASHER FOR TREATING DISHES

(71) Applicant: WHIRLPOOL CORPORATION, Benton Harbor, MI (US)

(72) Inventors: Alvaro Vallejo Noriega, Saint Joseph, MI (US); Rodney M. Welch, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 39 days.

This patent is subject to a terminal disclaimer.

(21) Appl. No.: 15/621,609

(22) Filed: Jun. 13, 2017

(65) Prior Publication Data

US 2017/0280963 A1 Oct. 5, 2017

Related U.S. Application Data

(63) Continuation of application No. 13/970,687, filed on Aug. 20, 2013, now Pat. No. 9,713,413, which is a continuation-in-part of application No. 13/932,086, filed on Jul. 1, 2013, now Pat. No. 9,297,553.

(51) Int. Cl.
*A47L 15/42* (2006.01)
*A47L 15/46* (2006.01)

(52) U.S. Cl.
CPC ..... *A47L 15/4206* (2013.01); *A47L 15/4225* (2013.01); *A47L 15/4285* (2013.01); *A47L 15/46* (2013.01)

(58) Field of Classification Search
CPC ..... A47L 15/4202; A47L 15/4204; A47L 15/4206; A47L 15/4225; A47L 15/4285; D06F 39/04; D06F 39/08; D06F 39/081; D06F 39/083; D06F 39/085; D06F 39/10
See application file for complete search history.

(56) References Cited

U.S. PATENT DOCUMENTS

| | | | |
|---|---|---|---|
| 1,750,170 | A | 3/1930 | Frisch |
| 1,966,572 | A | 7/1934 | Webb |
| 1,997,450 | A | 4/1935 | Burkle |
| 2,694,769 | A | 11/1954 | Huck et al. |
| 2,726,666 | A | 12/1955 | Oxford |
| 3,009,648 | A | 11/1961 | Hait |
| 3,064,664 | A | 11/1962 | Warhus |

(Continued)

FOREIGN PATENT DOCUMENTS

| | | |
|---|---|---|
| DE | 7024995 U | 3/1971 |
| DE | 4036930 A1 | 5/1992 |

(Continued)

OTHER PUBLICATIONS

European Search Report for Corresponding EP14173784.1, dated Oct. 29, 2014.

(Continued)

*Primary Examiner* — David G Cormier
(74) *Attorney, Agent, or Firm* — McGarry Bair PC

(57) ABSTRACT

A dishwasher for treating dishes according to at least one cycle of operation including a tub at least partially defining a treating chamber for receiving the dishes, at least one sprayer, a liquid recirculation system, a liquid filtering system including a housing defining and a filter located within the interior and a heater configured to heat liquid that has passed through the inlet opening of the housing.

20 Claims, 10 Drawing Sheets

(56) References Cited

U.S. PATENT DOCUMENTS

| | | | |
|---|---|---|---|
| 3,064,665 | A | 11/1962 | Martiniak |
| 3,146,953 | A | 9/1964 | Komanns |
| 3,160,164 | A | 12/1964 | Perl |
| 3,253,784 | A | 5/1966 | Long |
| 3,598,130 | A | 8/1971 | Nolte |
| 3,709,236 | A | 1/1973 | Field |
| 3,771,725 | A | 11/1973 | Cushing |
| 3,797,509 | A | 3/1974 | Oshima |
| 3,918,644 | A | 11/1975 | Platt et al. |
| 3,997,760 | A | 12/1976 | Salinger |
| 4,266,565 | A | 5/1981 | Gurubatham |
| 4,509,687 | A | 4/1985 | Cushing |
| 4,594,500 | A | 6/1986 | Wright |
| 4,924,069 | A | 5/1990 | Giordani |
| 4,993,444 | A | 2/1991 | Okabe |
| 5,331,986 | A | 7/1994 | Yun |
| 5,415,350 | A | 5/1995 | Yoon |
| 5,427,129 | A | 6/1995 | Hobday |
| 5,546,968 | A | 8/1996 | Jeon |
| 5,577,665 | A | 11/1996 | Chang |
| 5,601,100 | A | 2/1997 | Kato |
| 5,609,174 | A | 3/1997 | Ferguson |
| 5,655,556 | A | 8/1997 | Munini |
| 5,662,744 | A | 9/1997 | Tuller |
| 5,673,714 | A | 10/1997 | Munini |
| 5,692,885 | A | 12/1997 | Langer |
| 5,697,392 | A | 12/1997 | Jones |
| 5,944,037 | A | 8/1999 | Sinyong |
| 5,964,232 | A | 10/1999 | Chung |
| 6,053,185 | A | 4/2000 | Beevers |
| 6,325,083 | B1 | 12/2001 | Woerter |
| 6,692,093 | B1 | 2/2004 | Roh |
| 6,736,598 | B2 | 5/2004 | Kleemann et al. |
| 7,287,536 | B2 | 10/2007 | Jerg |
| 7,293,958 | B2 | 11/2007 | Kraffzik |
| 7,314,188 | B2 | 1/2008 | Kwok |
| 7,331,356 | B2 | 2/2008 | Thies |
| 7,445,013 | B2 | 11/2008 | Thies |
| 7,455,065 | B2 | 11/2008 | Schrott |
| 7,475,696 | B2 | 1/2009 | Vanderroest |
| 7,493,907 | B2 | 2/2009 | Roh |
| 7,523,758 | B2 | 4/2009 | Chen |
| 7,560,672 | B2 | 7/2009 | Pleschinger et al. |
| 7,594,513 | B2 | 9/2009 | Vanderroest et al. |
| 7,673,639 | B2 | 3/2010 | Shin |
| 7,810,512 | B2 | 10/2010 | Pyo |
| 7,896,977 | B2 | 3/2011 | Gillum |
| 7,935,194 | B2 | 5/2011 | Rolek |
| 7,959,744 | B2 | 6/2011 | Sundaram |
| 7,965,928 | B2 | 6/2011 | Kraffzik |
| 7,980,260 | B2 | 7/2011 | Bertsch |
| 8,113,222 | B2 | 2/2012 | Bertsch |
| 8,137,479 | B2 | 3/2012 | Thies |
| 8,187,390 | B2 | 5/2012 | Thies |
| 8,210,191 | B2 | 7/2012 | Ponnaganti |
| 8,245,718 | B2 | 8/2012 | Buesing |
| 8,282,741 | B2 | 10/2012 | Wilson |
| 8,989,566 | B2 | 3/2015 | Li |
| 9,402,526 | B2 | 8/2016 | Feddema |
| 9,532,699 | B2 | 1/2017 | Feddema |
| 9,839,340 | B2 | 12/2017 | Feddema |
| 2006/0011221 | A1 | 1/2006 | Schrott |
| 2006/0054201 | A1 | 3/2006 | Yoon |
| 2006/0101868 | A1 | 5/2006 | Schrott et al. |
| 2006/0108454 | A1 | 5/2006 | Eichholz |
| 2006/0278258 | A1 | 12/2006 | Kara |
| 2007/0056613 | A1 | 3/2007 | Haas |
| 2007/0289615 | A1 | 12/2007 | Shin |
| 2009/0071508 | A1 | 3/2009 | Sundaram |
| 2009/0101182 | A1 | 4/2009 | Groll |
| 2009/0101185 | A1 | 4/2009 | Pardini |
| 2009/0159103 | A1 | 6/2009 | Bhajak |
| 2010/0108102 | A1 | 5/2010 | Kehl |
| 2010/0139719 | A1 | 6/2010 | Gnadinger |
| 2010/0252081 | A1 | 10/2010 | Classen et al. |
| 2011/0030742 | A1 | 2/2011 | Dalsing |
| 2011/0146714 | A1 | 6/2011 | Fountain et al. |
| 2011/0146730 | A1 | 6/2011 | Welch |
| 2011/0146731 | A1 | 6/2011 | Fountain et al. |
| 2011/0203619 | A1 | 8/2011 | Kornberger |
| 2011/0284039 | A1 | 11/2011 | Christie |
| 2011/0303250 | A1 | 12/2011 | Delgado |
| 2012/0118330 | A1 | 5/2012 | Tuller et al. |
| 2012/0118336 | A1 | 5/2012 | Welch |
| 2012/0138096 | A1 | 6/2012 | Tuller et al. |
| 2012/0138106 | A1 | 6/2012 | Fountain et al. |
| 2012/0138107 | A1 | 6/2012 | Fountain et al. |
| 2012/0138111 | A1 | 6/2012 | Tuller et al. |
| 2012/0167928 | A1 | 7/2012 | Fountain et al. |
| 2012/0279530 | A1 | 11/2012 | Thiyagarajan |
| 2012/0279536 | A1 | 11/2012 | Sundaram |
| 2013/0074886 | A1 | 3/2013 | Vanderroest |
| 2013/0074887 | A1 | 3/2013 | Feddema |
| 2013/0074888 | A1 | 3/2013 | Feddema |
| 2013/0074890 | A1 | 3/2013 | Miller |
| 2013/0074891 | A1 | 3/2013 | Feddema |
| 2014/0054395 | A1 | 2/2014 | Holstein |
| 2014/0137909 | A1 | 5/2014 | Greenhaw |
| 2014/0246059 | A1 | 9/2014 | Feddema |
| 2014/0246060 | A1 | 9/2014 | Vanderroest |
| 2014/0332041 | A1 | 11/2014 | Feddema |
| 2015/0044073 | A1 | 2/2015 | Li |
| 2015/0086325 | A1 | 3/2015 | Albert |

FOREIGN PATENT DOCUMENTS

| | | | |
|---|---|---|---|
| DE | 20208544 | U1 | 10/2002 |
| DE | 102005026558 | B3 | 11/2006 |
| DE | 202008015058 | U1 | 2/2009 |
| DE | 102010043019 | A1 | 5/2012 |
| DE | 102011053666 | A1 | 5/2012 |
| EP | 0524102 | A1 | 1/1993 |
| EP | 0764421 | A1 | 3/1997 |
| EP | 0795292 | A2 | 9/1997 |
| EP | 0943281 | A2 | 9/1999 |
| EP | 0943282 | A2 | 9/1999 |
| EP | 1040786 | A1 | 10/2000 |
| EP | 1040787 | A1 | 10/2000 |
| EP | 1224902 | A2 | 7/2002 |
| EP | 1252856 | A2 | 10/2002 |
| EP | 1277430 | A1 | 1/2003 |
| EP | 1334687 | A1 | 8/2003 |
| EP | 1386575 | B1 | 10/2005 |
| EP | 1586264 | A2 | 10/2005 |
| EP | 1247993 | B1 | 3/2009 |
| EP | 2292134 | A1 | 3/2011 |
| EP | 2572622 | A1 | 3/2013 |
| EP | 2572623 | A1 | 3/2013 |
| EP | 2572624 | A1 | 3/2013 |
| GB | 2019204 | A1 | 10/1979 |
| GB | 2199734 | A1 | 7/1988 |
| GB | 2215990 | A1 | 10/1989 |
| JP | 650053120 | A2 | 3/1985 |
| JP | 4033632 | A2 | 2/1992 |
| JP | 5184514 | A2 | 7/1993 |
| JP | 8089467 | A2 | 4/1996 |
| JP | 9164107 | A2 | 6/1997 |
| JP | 10243910 | A2 | 9/1998 |
| JP | 11019019 | A2 | 1/1999 |
| JP | 11076127 | A2 | 3/1999 |
| JP | 2004113683 | A2 | 4/2004 |
| KR | 200156558 | Y1 | 9/1999 |
| KR | 20060029567 | A | 4/2006 |
| KR | 20090037299 | A | 4/2009 |
| WO | 2010012703 | A2 | 2/2010 |
| WO | 2011144540 | A2 | 11/2011 |
| WO | 2011154471 | A1 | 12/2011 |
| WO | 2012065873 | A2 | 5/2012 |

OTHER PUBLICATIONS

European Search Report for Corresponding EP14155444.4, dated May 26, 2014.

(56) References Cited

OTHER PUBLICATIONS

European Search Report for Corresponding EP14155441.0, dated May 30, 2014.
European Search Report for Corresponding EP14177086.7, dated Oct. 20, 2014.
German Search Report for Counterpart DE102013111241.2, dated May 23, 2014.
European Search Report for Corresponding EP 12185510.0, dated Dec. 19, 2012.
European Search Report for Corresponding EP 12185514.2, dated Dec. 6, 2012.
European Search Report for Corresponding EP 12185512.6, dated Dec. 6, 2012.

DISHWASHER FOR TREATING DISHES

CROSS-REFERENCE TO RELATED APPLICATIONS

The present application is a continuation of U.S. application Ser. No. 13/970,687, filed Aug. 20, 2013, now U.S. Pat. No. 9,713,413, which is a continuation-in-part of U.S. application Ser. No. 13/932,086, filed Jul. 1, 2013, now U.S. Pat. No. 9,297,553, both of which are incorporated by reference herein in their entirety.

BACKGROUND OF THE INVENTION

A dishwasher is a domestic appliance into which dishes and other cooking and eating wares (e.g., plates, bowls, glasses, flatware, pots, pans, bowls, etc.) are placed to be washed. The dishwasher may include a heater to heat liquid circulated onto the dishes.

BRIEF DESCRIPTION OF THE INVENTION

In one aspect, the invention relates to a dishwasher for treating dishes according to at least one cycle of operation including a tub at least partially defining a treating chamber for receiving the dishes, at least one sprayer, a liquid recirculation system defining a recirculation flow path, a liquid filtering system including a housing defining an interior and having an inlet opening fluidly coupled with the recirculation flow path and a filter located within the interior and a heater on an exterior of the housing and configured to heat liquid that has passed through the inlet opening of the housing.

DESCRIPTION OF EMBODIMENTS OF THE INVENTION

Figure 1:
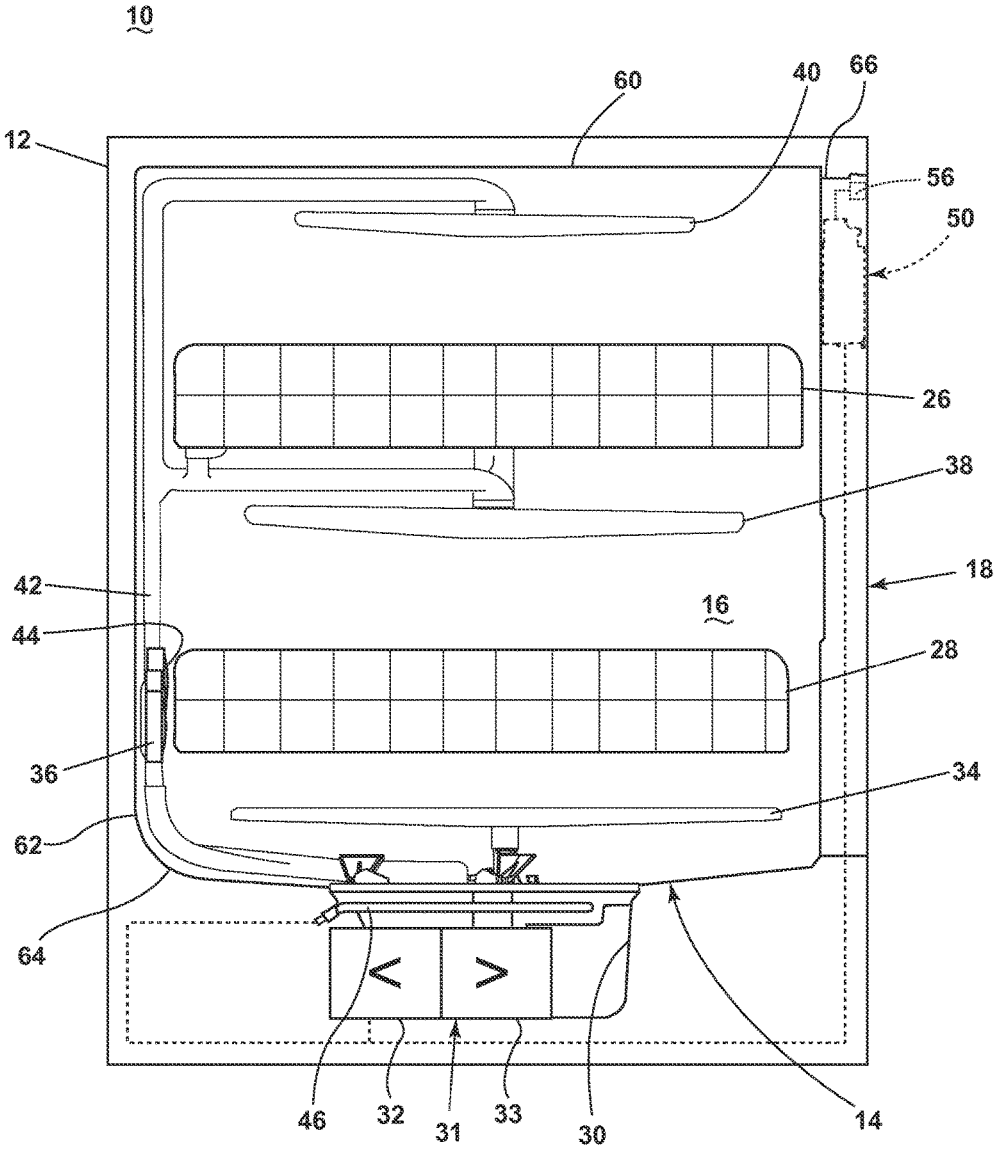
FIG. 1 is a schematic, cross-sectional view of a dishwasher according to a first embodiment of the invention.

In FIG. 1, an automated dishwasher 10 according to a first embodiment is illustrated. The dishwasher 10 shares many features of a conventional automated dishwasher, which will not be described in detail herein except as necessary for a complete understanding of the invention. A chassis 12 may define an interior of the dishwasher 10 and may include a frame, with or without panels mounted to the frame. An open-faced tub 14 may be provided within the chassis 12 and may at least partially define a treating chamber 16, having an open face, for washing dishes. A door assembly 18 may be movably mounted to the dishwasher 10 for movement between opened and closed positions to selectively open and close the open face of the tub 14. Thus, the door assembly provides accessibility to the treating chamber 16 for the loading and unloading of dishes or other washable items.

It should be appreciated that the door assembly 18 may be secured to the lower front edge of the chassis 12 or to the lower front edge of the tub 14 via a hinge assembly (not shown) configured to pivot the door assembly 18. When the door assembly 18 is closed, user access to the treating chamber 16 may be prevented, whereas user access to the treating chamber 16 may be permitted when the door assembly 18 is open.

Dish holders, illustrated in the form of upper and lower dish racks 26, 28, are located within the treating chamber 16 and receive dishes for washing. The upper and lower racks 26, 28 are typically mounted for slidable movement in and out of the treating chamber 16 for ease of loading and unloading. Other dish holders may be provided, such as a silverware basket. As used in this description, the term "dish(es)" is intended to be generic to any item, single or plural, that may be treated in the dishwasher 10, including, without limitation, dishes, plates, pots, bowls, pans, glassware, and silverware.

A spray system is provided for spraying liquid in the treating chamber 16 and includes sprayers provided in the form of a first lower spray assembly 34, a second lower spray assembly 36, a rotating mid-level spray arm assembly 38, and/or an upper spray arm assembly 40, which are proximate to the tub 14 to spray liquid into the treating chamber 16. Upper spray arm assembly 40, mid-level spray arm assembly 38 and lower spray assembly 34 are located, respectively, above the upper rack 26, beneath the upper rack 26, and beneath the lower rack 24 and are illustrated as rotating spray arms. The second lower spray assembly 36 is illustrated as being located adjacent the lower dish rack 28 toward the rear of the treating chamber 16. The second lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system is provided for recirculating liquid from the treating chamber 16 to the spray system. In this manner, the liquid recirculation system defines a recirculation flow path fluidly coupled to at least one sprayer of the spray system. The recirculation flow path may include multiple recirculation circuits including that the multiple recirculation circuits may be fluidly coupled to the various assemblies 34, 36, 38, and 40 for selective spraying. The recirculation system may include a sump 30 and a pump assembly 31. The sump 30 collects the liquid sprayed in the treating chamber 16 and may be formed by a sloped or recessed portion of a bottom wall of the tub 14. The pump assembly 31 may include both a drain pump assembly 32 and a recirculation pump assembly 33. The drain pump assembly 32 may draw liquid from the sump 30 and pump the liquid out of the dishwasher 10 to a household drain line (not shown). The recirculation pump assembly 33 may be fluidly coupled between the treating chamber 16 and the spray system to define a circulation circuit for circulating the sprayed liquid. More specifically, the recirculation pump assembly 33 may draw liquid from the sump 30 and the liquid may be simultaneously or selectively pumped through a supply tube 42 to each of the assemblies 34, 36, 38, 40 for selective spraying. While not shown, a liquid supply system may include a water supply conduit coupled with a household water supply for supplying water to the treating chamber 16.

A heating system including a heater 46 may be located within the sump 30 for heating the liquid contained in the sump 30.

A controller 50 may also be included in the dishwasher 10, which may be operably coupled with various components of the dishwasher 10 to implement a cycle of operation. The controller 50 may be located within the door 18 as illustrated, or it may alternatively be located somewhere within the chassis 12. The controller 50 may also be operably coupled with a control panel or user interface 56 for receiving user-selected inputs and communicating information to the user. The user interface 56 may include operational controls such as dials, lights, switches, and displays enabling a user to input commands, such as a cycle of operation, to the controller 50 and receive information.

Figure 2:
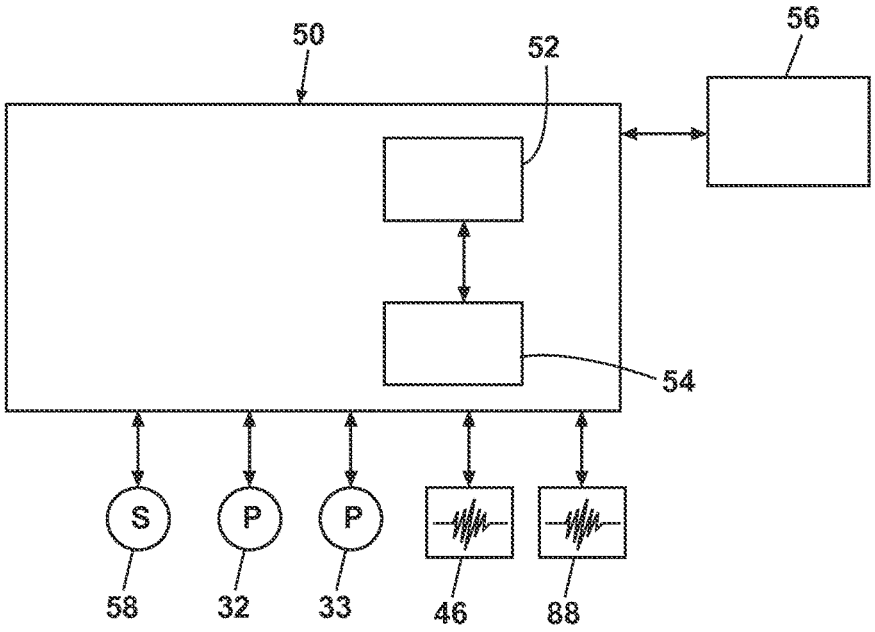
FIG. 2 is a schematic view of a controller of the dishwasher of FIG. 1.

As illustrated schematically in FIG. 2, the controller 50 may be coupled with the heater 46 for heating the wash liquid during a cycle of operation, the drain pump assembly 32 for draining liquid from the treating chamber 16, and the recirculation pump assembly 33 for recirculating the wash liquid during the cycle of operation. The controller 50 may be provided with a memory 52 and a central processing unit (CPU) 54. The memory 52 may be used for storing control software that may be executed by the CPU 54 in completing a cycle of operation using the dishwasher 10 and any additional software. For example, the memory 52 may store one or more pre-programmed cycles of operation that may be selected by a user and completed by the dishwasher 10. The controller 50 may also receive input from one or more sensors 58. Non-limiting examples of sensors that may be communicably coupled with the controller 50 include a temperature sensor and a turbidity sensor to determine the soil load associated with a selected grouping of dishes, such as the dishes associated with a particular area of the treating chamber.

Figure 3:
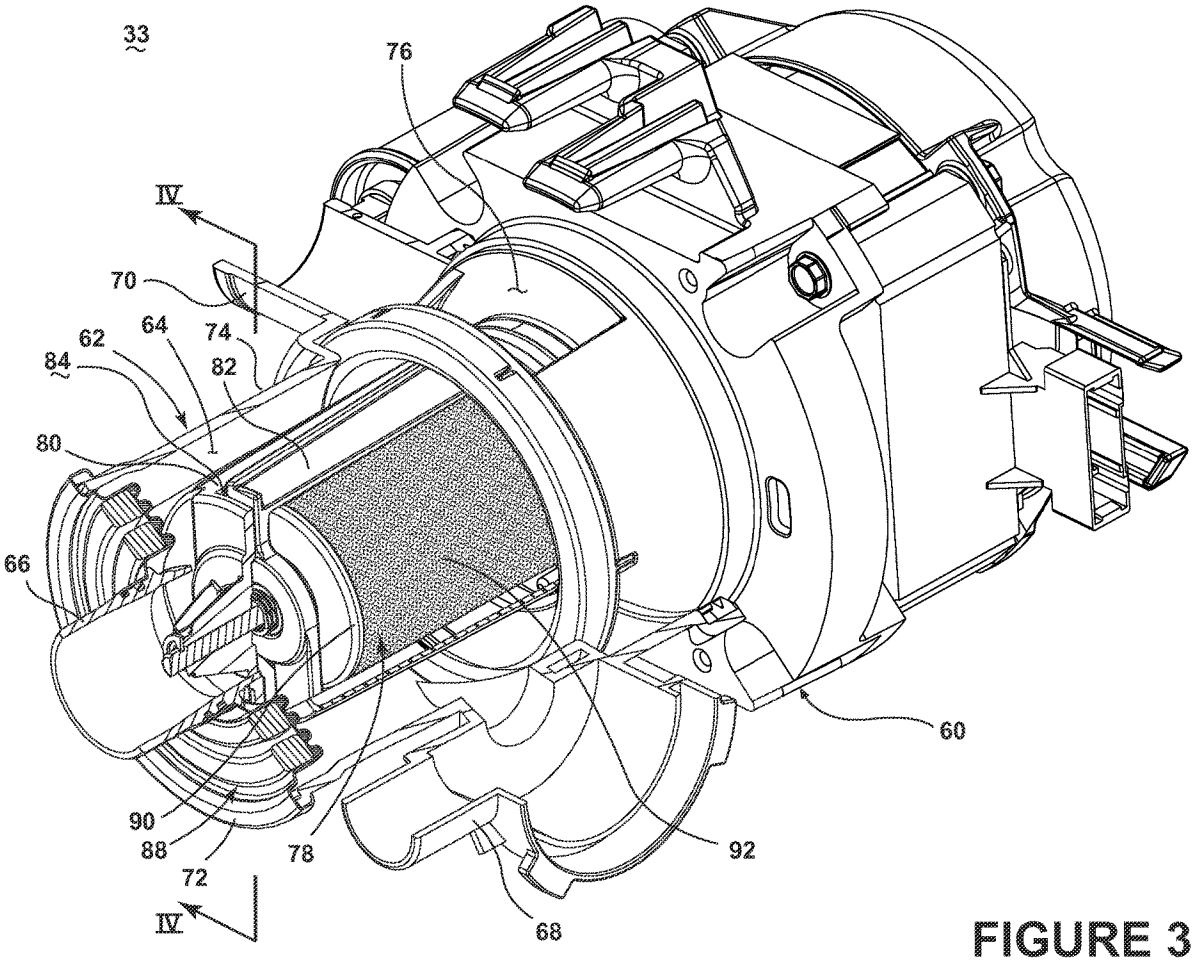
FIG. 3 is a perspective view of an embodiment of a pump and filter assembly of the dishwasher of FIG. 1 with portions cut away for clarity.

Referring now to FIG. 3, the recirculation pump assembly 33 is shown removed from the dishwasher 10. The recirculation pump assembly 33 includes a recirculation pump 60 that is secured to a housing 62, which is shown partially cutaway for clarity. The housing 62 defines an interior or filter chamber 64 that extends the length of the housing 62 and includes an inlet port 66, a drain outlet port 68, and a recirculation outlet port 70. As illustrated, an end portion 72 may be operably coupled to or formed with a sidewall 74 to form the housing 62. For example, the end portion 72 may be formed by a separate end plate that is operably coupled with the sidewall 74. The inlet port 66 may be operably coupled with or formed in the end portion 72. The inlet port 66 is configured to be coupled to a fluid hose (not shown) extending from the sump 30. The filter chamber 64, depending on the location of the recirculation pump assembly 33, may functionally be part of the sump 30 or replace the sump 30. The drain outlet port 68 for the recirculation pump 60, which may also be considered the drain pump inlet port, may be coupled to the drain pump assembly 32 such that actuation of the drain pump assembly 32 drains the liquid and any foreign objects within the filter chamber 64. The recirculation outlet port 70 is configured to receive a fluid hose (not shown) such that the recirculation outlet port 70 may be fluidly coupled to the recirculation flow path, which is fluidly coupled to the liquid spraying system including the assemblies 34, 36, 38, 40. The recirculation outlet port 70 is fluidly coupled to an impeller chamber 76 of the recirculation pump 60 such that when the recirculation pump 60 is operated liquid may be supplied to each of the assemblies 34, 36, 38, 40 for selective spraying. In this manner, the recirculation pump 60 includes an inlet fluidly coupled to the tub 14 and an outlet fluidly coupled to the liquid spraying system to recirculate liquid from the tub 14 to the treating chamber 16.

A liquid filtering system may be included within the recirculation pump assembly 33 and is illustrated as including a rotating filter 78, a shroud 80, and a diverter 82. The rotating filter 78 may be located in the housing 62 and fluidly disposed between the inlet port 66 and the recirculation outlet port 70 to filter liquid passing through the filter chamber 64. The shroud 80 may wrap around the rotating filter 78 and may include one or more access openings 84 to allow liquid to reach the rotating filter 78. Because the housing 62 is located within the chassis 12 but physically remote from the tub 14, the rotating filter 78 is not directly exposed to the tub 14. In this manner, the housing 62 and the rotating filter 78 may be thought of as defining a filter unit, which is separate and remote from the tub 14. The rotating filter 78 may be a fine filter, which may be utilized to remove smaller particles from the liquid. The rotating filter 78 may utilize the shroud 80 and the diverter 82 to aid in keeping the rotating filter 78 clean, such a rotating filter 78 and additional elements such as the shroud 80 and diverter 82 are set forth in detail in U.S. patent application Ser. No. 13/483,254, filed May 30, 2012, now U.S. Pat. No. 9,237,836, issued Jan. 19, 2016, and titled "Rotating Filter for a Dishwasher," which is incorporated herein by reference in its entirety. The rotating filter according to U.S. patent application Ser. No. 13/483,254, now U.S. Pat. No. 9,237,836, issued Jan. 19, 2016, may be operably coupled to an impeller 86 (FIG. 4) of the recirculation pump 60 such that when the impeller 86 rotates the rotating filter 78 is also rotated. In this manner the impeller 86 may effect the rotation of the rotating filter 78.

A heater 88 is illustrated as being located adjacent the inlet port 66 of the housing 62. The heater 88 is upstream of the rotating filter 78 and may be configured to heat liquid that has passed through the inlet port 66 of the housing 62. In the illustrated example, the heater 88 encircles the inlet port 66. While not illustrated, the heater 88 may be operably coupled with the controller 50 such that the heater 88 may heat liquid that has passed through the inlet port 66 during the cycle of operation. The heater 88 may be any suitable heater for heating liquid that has passed through the inlet port 66 including that the heater 88 may take any suitable shape and form. For example, the heater 88 may include multiple concentric coils encircling the inlet port 66. By way of further example, the heater 88 may include at least one of a rectilinear and trapezoidal cross section.

Figure 4:
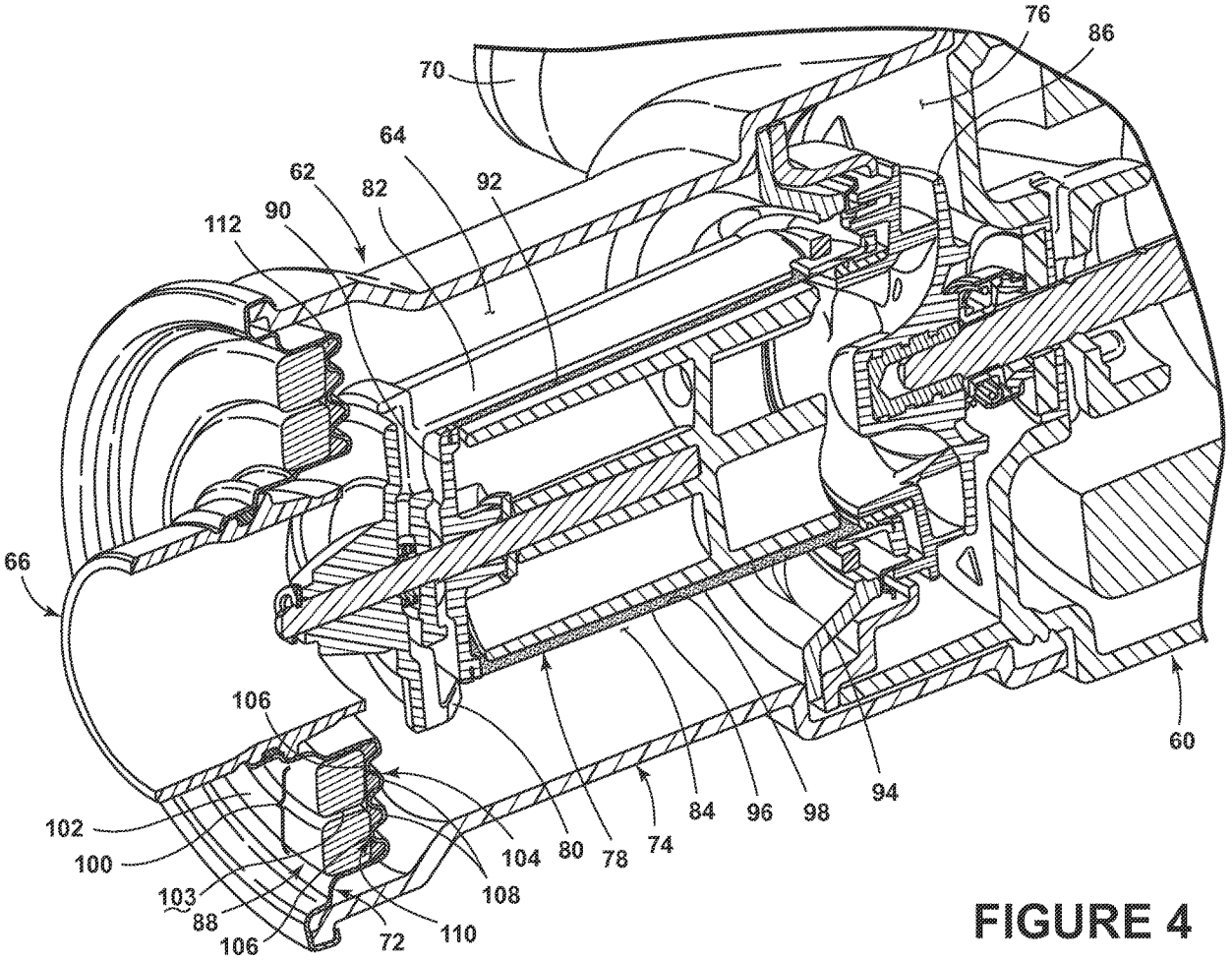
FIG. 4 is a cross-sectional view of the pump and filter assembly of FIG. 3 taken along the line Iv-Iv shown in FIG. 3.

FIG. 4 more clearly illustrates that the rotating filter 78 may include a hollow body formed by a frame 90 and a screen 92. The hollow body of the rotating filter 78 may be any suitable shape including that of a cone or a cylinder. The screen 92 may include a plurality of openings 94 through which liquid may pass. The plurality of openings 94 may have a variety of sizes and spacing. The screen 92 may have a first surface defining an upstream surface 96 and a second surface defining a downstream surface 98. The rotating filter 78 may be located within the recirculation flow path such that the circulated liquid passes through the rotating filter 78 from the upstream surface 96 to the downstream surface 98 to effect a filtering of the liquid. In the described flow direction, the upstream surface 96 correlates to the outer surface of the rotating filter 78 and the downstream surface 98 correlates to the inner surface of the rotating filter 78 such that the rotating filter 78 separates the upstream portion of the filter chamber 64 from the outlet port 70.

It may also be more easily seen that the end-plate forming the end portion 72 of the housing 62 has a projection that projects into the filter chamber 64 and extends toward the rotating filter 78 to locate the heater 88 adjacent the inlet port 66 and liquid that has passed there through. The end portion 72 at least partially defines a channel 100 in which a heating element 102 of the heater 88 may be at least partially received to heat liquid that has passed through the inlet opening of the housing. The depth to which the channel 100 may extend into the filter chamber 64 may vary. Heat transfer may occur through the end portion 72 forming the channel 100 such that liquid that has passed into the filter chamber 64 may be heated.

The heating element 102 of the heater 88 has been illustrated as a calrod heating element. Although one such example of a heating element 102 is described as a calrod, many different heating elements may be acceptable in embodiments of the current invention. More specifically, a dually wound heating element 102 is shown positioned within the channel 100. As shown, rotational segments of the dually wound heating element 102 may be separated by a gap 103. Alternative patterns of positioning a heating element 102 within at least a portion of the channel 100 are contemplated. For example, the heating element 102 may have a single winding, more than two windings, or a zigzag winding (i.e. in short, radially inward and outward segments) within the channel 100. In another example, dual heating elements 102 may be configured to encircle the channel 100.

The channel 100 may also include convolutions 104 extending from a portion of the end portion 72 into the housing 62. In the illustrated example, the convolutions 104 include peaks 106 and valleys 108, with at least a portion of the valleys 108 extending away from the heater 88 such that the valleys 108 are not in direct contact with the heating element 102. The peaks 106 may define at least a portion of a heater seat 110 on which at least a portion of the heating element 102 rests such that the peaks 106 and heating elements 102 are thermal coupled. The space between the heating element 102 and valleys 108 of the convolutions 104 may additionally be filled with an optional filling material, such as a thermally conductive brazing material 112, wherein the filling material may include a portion of the heater seat 110. Further, while not illustrated, a thermally conductive material, such as brazing material 112, may fill the gap 103 between the heating element 102 segments. Alternatively, the heating element 102 may not be physically received by the heater seat 110, so long as the heating element 102 may be proximately located to provide for heat transference to liquid that has passed through the inlet port 66 of the housing 62.

While the convolutions 104 are only shown on one side of the channel 100, the convolutions 104 may be provided on any portion of the end portion 72 in fluid contact with the filter chamber 64. The configuration of the heating element 102 and convolutions 104 defines a heat transfer area operably increasing the surface area of the heater seat 110 that is in conductive contact with the filter chamber 64, which in turn increases the rate at which heat is transferred to the liquid that has passed through the inlet port 66 of the housing 62. The increased rate of heat transfer to the liquid is provided without increasing the corresponding size of the heating element 102. The convolutions 104 increase the area through which heat passes, thus lowering the temperature of the surface and the temperature of the boundary layer of the water passing over this surface. The filling of the valleys 108 with brazing material 112 further enhances the conductive transfer as heat is conducted to the convolutions 104, where otherwise the heat would first transfer by convection with the air in the valleys 108 before conduction to the liquid.

In operation, wash liquid, such as water and/or treating chemistry (i.e., water and/or detergents, enzymes, surfactants, and other cleaning or conditioning chemistry), enters the tub 14 and flows into the sump 30 to the inlet port 66 where the liquid may enter the filter chamber 64. As the filter chamber 64 fills, liquid passes through the perforations in the rotating filter 78. After the filter chamber 64 is completely filled and the sump 30 is partially filled with liquid, the dishwasher 10 activates a motor of the recirculation pump assembly 33. During an operation cycle, a mixture of liquid and foreign objects such as soil particles may advance from the sump 30 into the filter chamber 64 to fill the filter chamber 64.

Activation of the motor of the recirculation pump assembly 33 causes the impeller 86 and the rotating filter 78 to rotate. The liquid in the recirculation flow path flows into the filter chamber 64 from the inlet port 66. The rotation of the filter 78 causes the liquid and soils therein to rotate in the same direction within the filter chamber 64. The recirculation flow path may circumscribe at least a portion of the shroud 80 and enters through access openings 84 therein. The rotation of the impeller 86 draws liquid from the filter chamber 64 and forces the liquid by rotation of the impeller 86 outward such that it is advanced out of the impeller chamber 76 through the recirculation outlet port 70 to the assemblies 34, 36, 38, 40 for selective spraying. When liquid is delivered to the assemblies 34, 36, 38, 40, it is expelled from the assemblies 34, 36, 38, 40 onto any dishes positioned in the treating chamber 16. Liquid removes soil particles located on the dishes, and the mixture of liquid and soil particles falls onto the bottom wall of the tub 14. The sloped configuration of the bottom wall of the tub 14 directs that mixture into the sump 30. The recirculation pump 60 is fluidly coupled downstream of the downstream surface of the rotating filter 78 and if the recirculation pump 60 is shut off then any liquid and soils within the filter chamber will settle in the filter chamber 64 where the liquid and any soils may be subsequently drained by the drain pump assembly 32.

While liquid is being recirculated within the dishwasher 10, a power or heating source may selectively energize the heater 88, causing the heater 88 to generate heat. The heat generated by the heater 88 may be thermally conducted through the channel 100, heater seat 110, brazing material 112 (if present), convolutions 104 and any non-convoluted sides of the channel 100 to heat liquid that has passed through the inlet port 66 of the housing 62.

Figure 5:
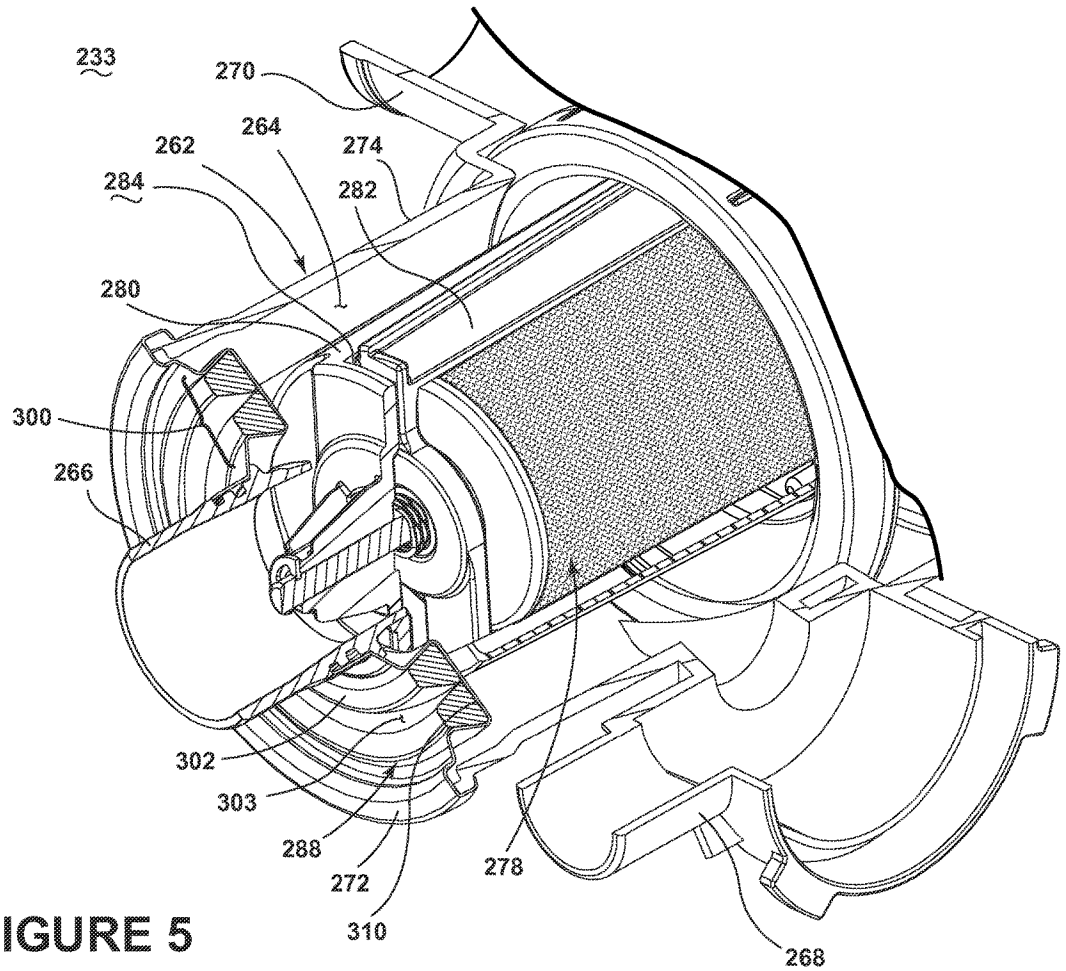
FIG. 5 is a partial perspective view of an alternative embodiment of a pump and filter assembly of the dishwasher of FIG. 1 with portions cut away for clarity.

FIG. 5 illustrates a perspective view of an alternative recirculation pump assembly 233 and heater 288 according to a second embodiment of the invention. The recirculation pump assembly 233 and heater 288 are similar to the recirculation pump assembly 33 and heater 88 previously described and therefore, like parts will be identified with like numerals increased by 200, with it being understood that the description of the like parts of the recirculation pump assembly 33 and heater 88 applies to the recirculation pump assembly 233 and heater 288, unless otherwise noted.

One difference is that the cross section of the heating elements 302 is trapezoidal. Further, no convolutions have been included and the channel 300 and heater seat 310 conform to the shape of the heating element 102. The heater 288 operates the same as the previously described embodiment to heat liquid that has passed through the inlet port 266 of the housing 262.

Figure 6:
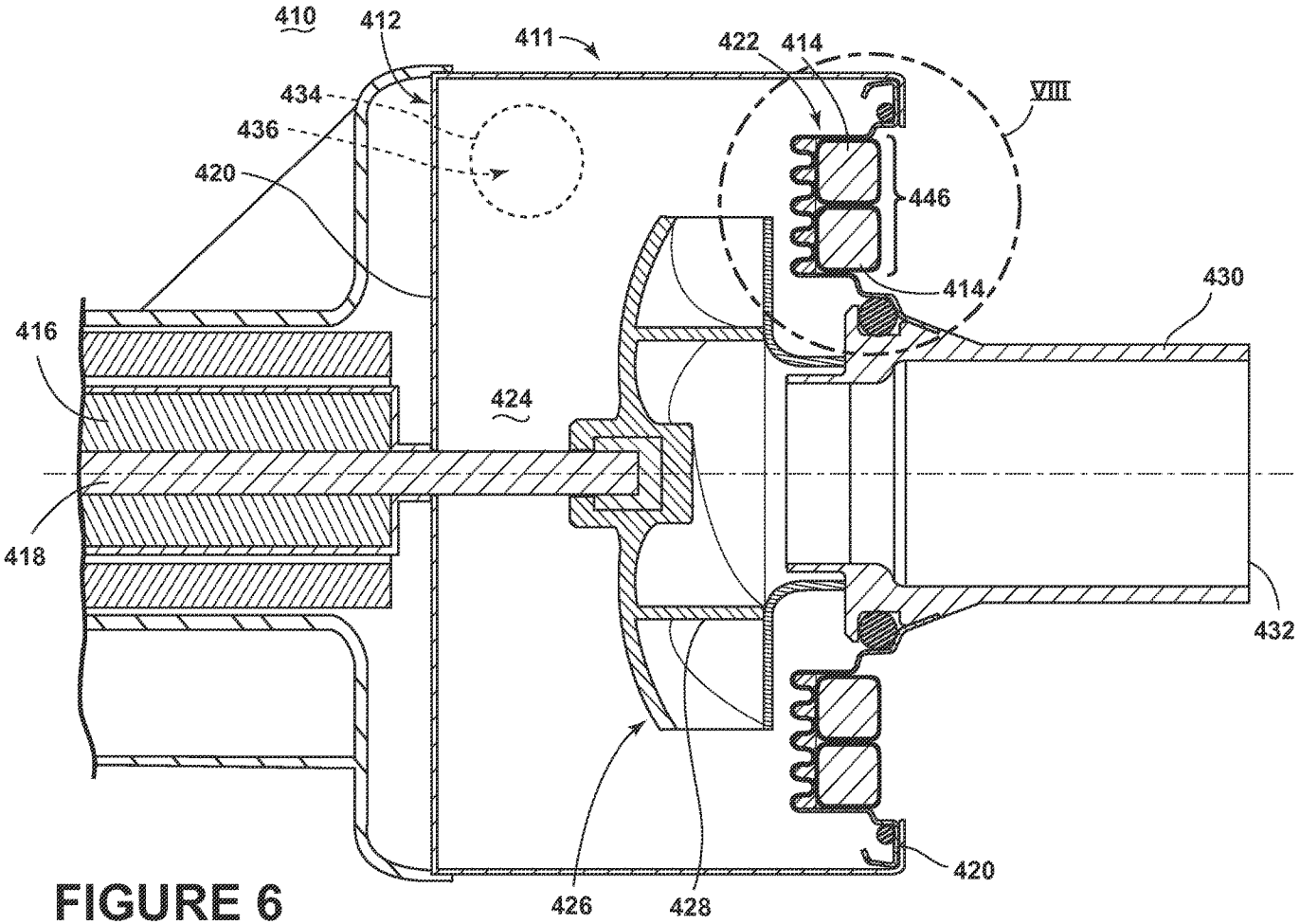
FIG. 6 is a sectional view illustrating a portion of a pump assembly with a heating element according to another embodiment of the invention.

It will be understood that embodiments of the invention may be implemented in any environment using a pump assembly for heating and transferring liquid. Further, while the illustrated pump assembly has particular utility in a dishwashing machine, the pump assembly may be also applicable to any appliance configured to use heated liquid. FIG. 6 illustrates a pump assembly 410 according to another embodiment of the invention. The pump assembly 410 may be functionally divided into a motor 416 and a pump 411 having a housing 412, which couples the pump to the motor 416 and defines a volute chamber 424. A heating element 414 is provided on the housing 412. The motor 416 includes an output shaft 418 that extends into the volute chamber 424. The pump 411 further includes an impeller 426, having impeller blades 428, located within the volute chamber 424 and is mounted or coupled with the output shaft 418, such that the rotation of the output shaft 418 by the motor 16 rotates the impeller 426. The impeller blades 428 are configured such that the rotation of the impeller 426 by the motor 416 defines a centrifugal pump for moving liquid about the housing 412.

The pump 411 additionally includes an inlet passageway 430, having an opening 432, coupled to an end of the housing 412, and an outlet passageway 434, having an opening 436, coupled in a side of the housing 412. A portion of the housing 412 projects into the volute chamber 424 to define a projection 422 confronting the volute chamber 424, which also defines an exterior channel 446 in which the heating element 414 is at least partially received. The housing 412, volute chamber 424, sidewalls 420, and inlet and outlet passageways 430, 434 are arranged in a watertight configuration such that the rotation of the impeller 426 receives liquid within the opening 432 of the inlet passageway 30, and forcibly moves the liquid into the volute chamber 424, past the sidewall 420 having a projection 422, and out the opening 436 of the outlet passageway 434. In this sense, the projection 422 may have at least one side in fluid contact with the volute chamber 424, or liquid therein, and is shown having three sides in fluid contact. The passage of the output shaft 418 is sealed off in a manner not illustrated in greater detail.

The heating element 414, illustrated as a calrod, may be configured to use an energizable power source to generate heat, and is provided on the exterior of the housing 412, wherein the element 414 may be received by at least a portion of the projection 422. Although one such example of a heating element 414 is described as a calrod, many different heating elements may be acceptable in embodiments of the current invention.

Figure 7:
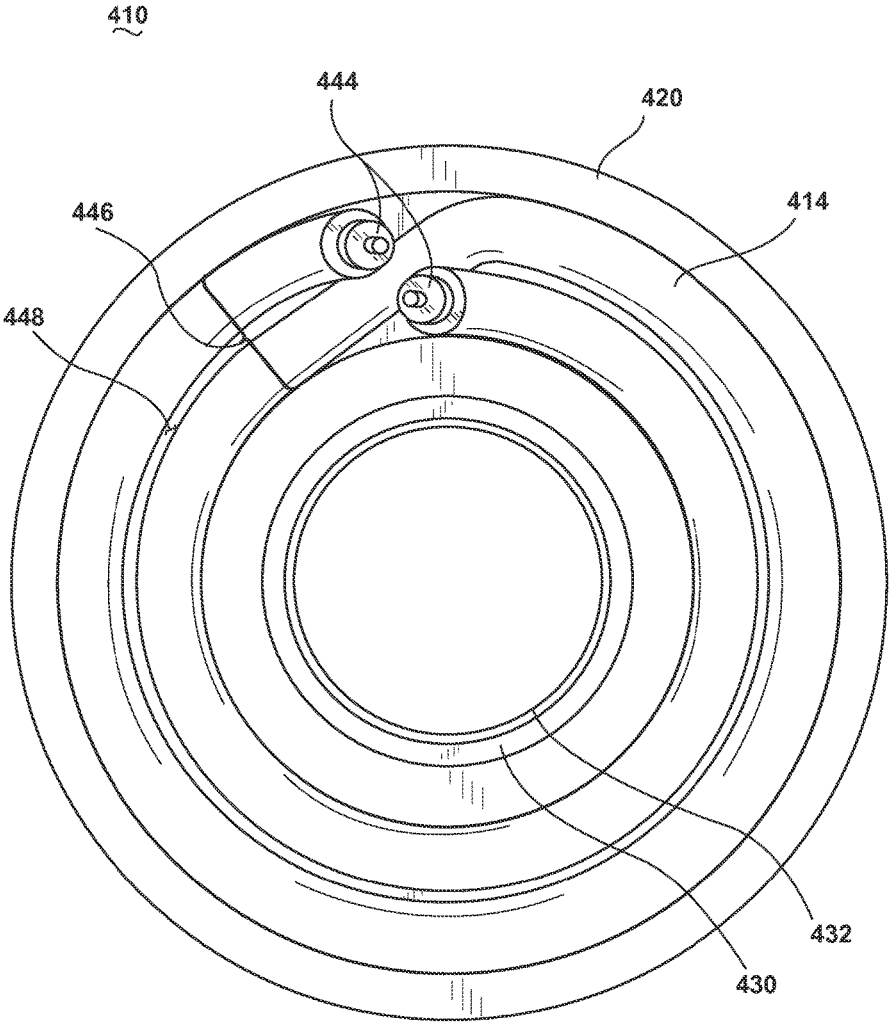
FIG. 7 is an end view showing the heating element resting in the projection of FIG. 6.

FIG. 7 better illustrates that the sidewall 420 having the projection 422 defines a substantially circular surface, having a continuous annular groove, for example, a channel 446, corresponding to a radial segment of the opposing side of the projection 422. At least a portion of the channel 446 may be at least twice as wide as the heating element 414.

A dually wound heating element 414 is shown positioned within the channel 446 such that the element 414 contains more than one cross sectional segment within a cross sectional plane in at least a portion of the channel 446 or projection 422. As shown, rotational segments of the dually wound heating element 414 are separated by at least a gap 448. Alternative patterns of positioning a heating element 414 within at least a portion of the channel 446 are envisioned. For example, the heating element 414 may have more than two windings, or a zig-zag winding (i.e. in short, radially inward and outward segments) within the channel 446. In another example, dual heating elements 414 may be configured to encircle the channel 446 in a similar dual-winding pattern. In yet another example, a single heating element 414 may be configured in more than one winding pattern.

The heating element 414 further includes terminating end caps 444 that may be used to electrically couple the element 414 with the energizable power source (not shown). Alternative methods of heat supply and corresponding end caps 44 are envisioned.

Figure 8:
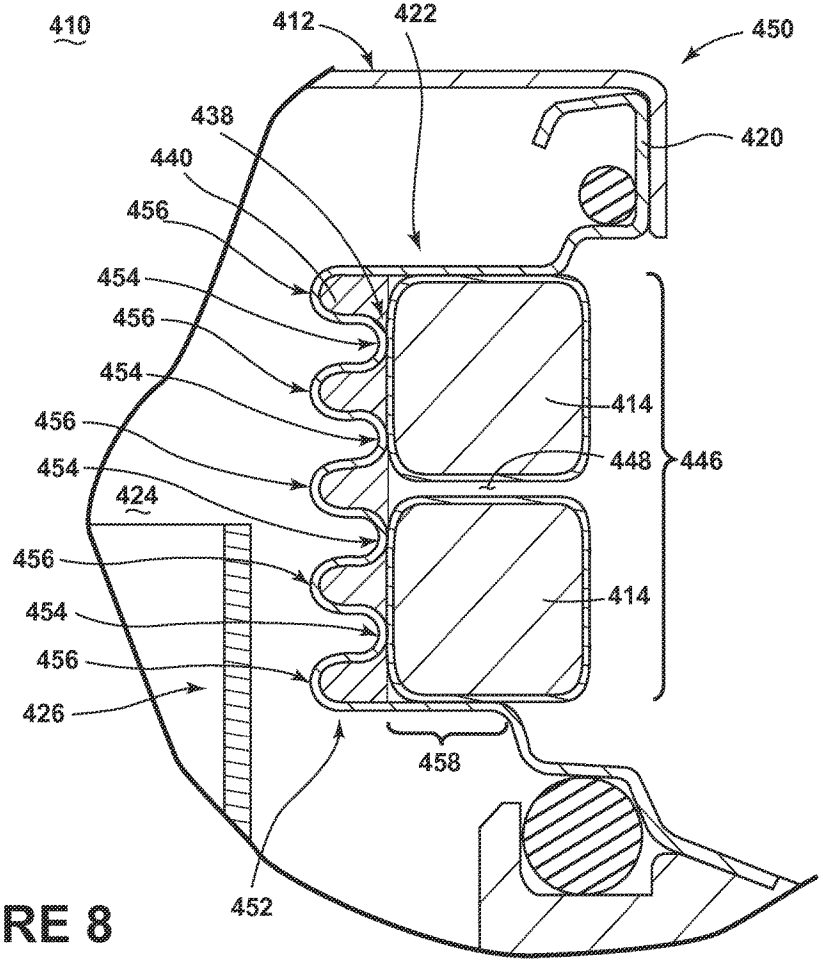
FIG. 8 illustrates an enlarged detail section VIII of FIG. 6 showing the heat transfer area.

As best seen in FIG. 8, a gap 448 may be formed between the dually wound heating elements 414, with the outer surfaces of the heating elements 414 abutting the portion of the housing 412 forming the heater seat 438. As shown, the heater seat 438 conforms to the shape of the heating element 414.

The projection 422 may further include a plurality of convolutions 452 having peaks 454 and valleys 456, with at least a portion of the valleys 456 extending away from the projection 422 such that the valleys 456 are not in direct contact with the heating element 414. The peaks 454 may define at least a portion of the heater seat 438, wherein the peaks 454 and heating elements 414 are thermal coupled. The space between the heating element 414 and valleys 456 of the convolutions 452 may additionally be filled with an optional filling material, such as a thermally conductive brazing material 440, wherein the filling material may include a portion of the heater seat 438. While not illustrated, a brazing material 440 may fill the gap 448 between the heating element 414 segments. Alternatively, the heating element 414 may not be physical received by the heater seat 438, so long as the element 414 may be proximately located to provide for heat transference from the element 414 to the projection 422.

While the convolutions 452 are only shown on one side of the projection 422, the convolutions 452 may be provided on any or more of the three sides of the projection 422 in fluid contact with the volute chamber 424. Additionally, in embodiments where the projection 422 may have an alternate cross sectional shape, which may not have well-defined sides, it is envisioned at least a portion of the projection 422 may have the convolutions 452.

The configuration of the heating element 414 and convolutions 452 defines a heat transfer area 450 operably increasing the surface area of the heater seat 438 that is in conductive contact with the volute chamber 424, which in turn increases the rate at which heat is transferred to the liquid. The increased rate of heat transfer to the liquid is provided without increasing the corresponding size of the heating element 414. The filling of the valleys 456 with brazing material 440 further enhances the conductive transfer as heat is conducted to the convolutions 452, where otherwise the heat would first transfer by convection with the air in the valleys before conduction to the liquid.

The depth 458 to which the projection may extend into the volute chamber may vary. As illustrated, the depth 458 is slightly greater than half the height of the heating element 414. However, the depth 458 can be more or less, and can even include a depth greater than the height of the heating element 414. While the depth 458 is illustrated as more than half the height of the heating element 414, the amount of cross section area of the heating element in contact with the heater seat is less than fifty percent, a greater or lesser amount of the surface of the heating element may be in contact with the heater seat.

During operation of the pump assembly 410, the motor 416 operatively rotates the impeller 426 such that the liquid within the housing 412 traverses through the volute chamber 424, past the sidewall 420 having the projection 422. A power or heating source selectively energizes the heating element 414, causing the heating element 414 to generate heat. The heat generated by the heating element 414 may be thermally conducted through the channel 446, heater seat 438, brazing material 440 (if present), convolutions 452 and any non-convoluted sides of the projection 422, to the volute chamber 424, and consequently, to the traversing liquid as it flows past the projection 422 on its path to the outlet passageway 434.

The traversing liquid will pass through the peaks 454 and valleys 456 of the convolutions 452, which provides an increased surface area, and consequently, an increased heat transfer area 450 and enhanced rate of conduction, as compared to a flat surface. Due to the enhanced rate of conduction at the heat transfer area 50 in the current embodiments, a heating element 414 may be selected such that the thermal output of the heating element 414 is greater, because it is not limited to the conduction rate of a flat wall.

Figure 9:
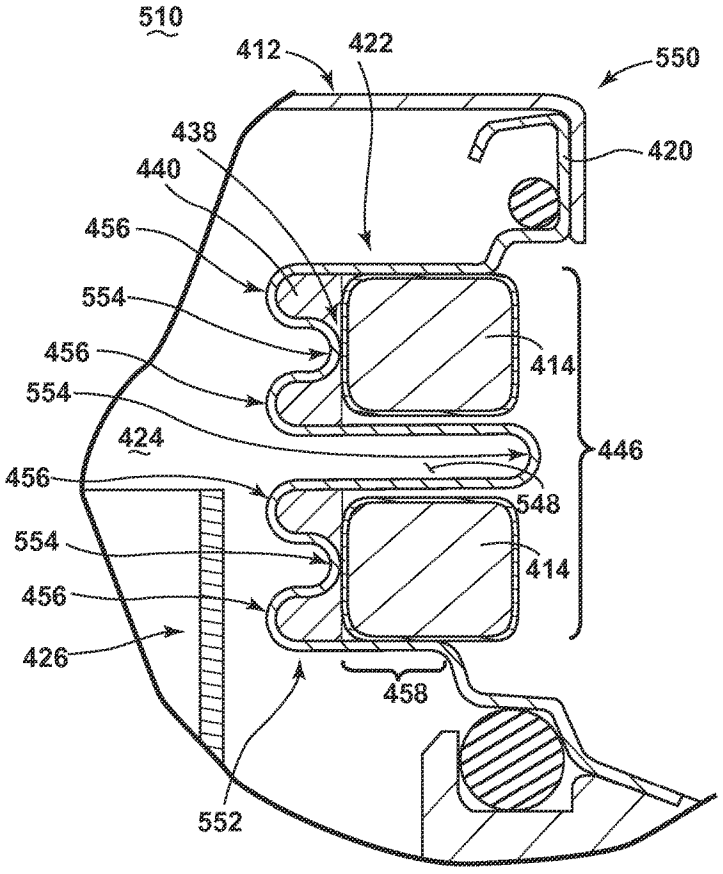
FIG. 9 is a view similar to FIG. 8 and illustrates an alternative structure for the heating element and casing.

Furthermore, FIG. 9 illustrates a pump assembly 510 according to yet another embodiment of the invention. The pump assembly 510 may be similar to the pump assembly 410; therefore, like parts will be identified with like numerals increased by 100, with it being understood that the description of the like parts of the pump assembly 410 applies to the pump assembly 510, unless otherwise noted. One difference is that the heat transfer area 550 includes convolutions 552 having at least one peak 554 that extends into the gap 548 between the dually wound heating element 414. Additionally the space between the heating element 414 and the convolutions 552 may be filled with an optional brazing material 440.

Figure 10:
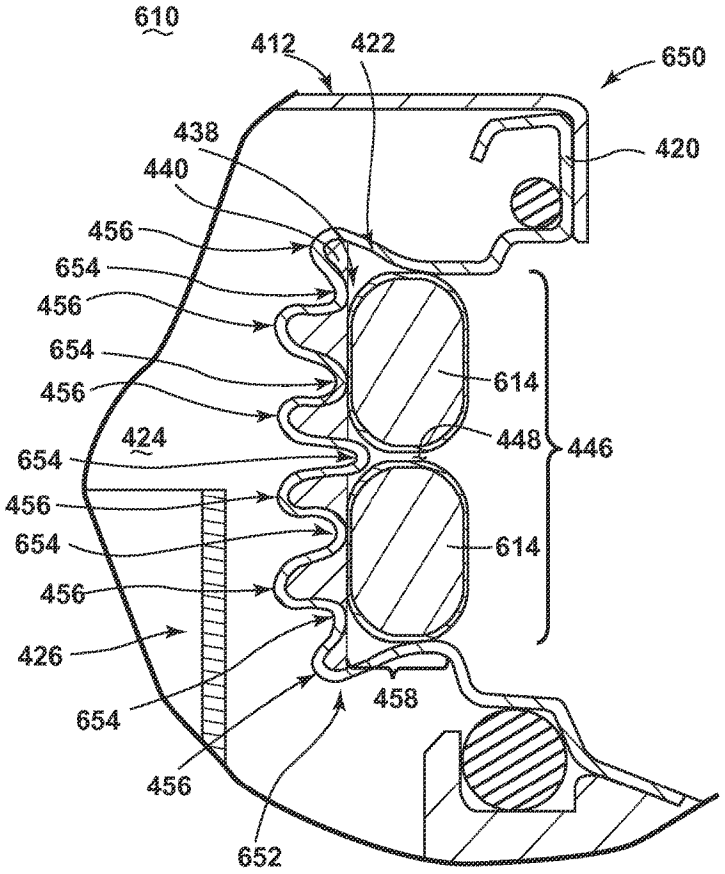
FIG. 10 is a view similar to FIGS. 8 and 9 and illustrates an alternative structure for the heating element and casing.

FIG. 10 illustrates a pump assembly 610 according to another embodiment of the invention. The pump assembly 610 may be similar to the earlier pump assemblies 410 and 510; therefore, like parts will be identified with like numerals increased by 200, with it being understood that the description of the like parts of the pump assembly 410 applies to the pump assembly 610, unless otherwise noted. One difference is that the heating element 614 has an ovate cross section. Additionally, the convolutions 652 of the heat transfer area 650 are shown conforming to the alternative heating element 614 cross sectional shape. Alternatively, the convolutions 652 may continue to use a more planar conformation regardless of the heating element 614 cross sectional shape, such as the convolutions 452 shown in the pump assembly 410. Additionally, alternate cross sectional shapes are envisioned.

Figure 11:
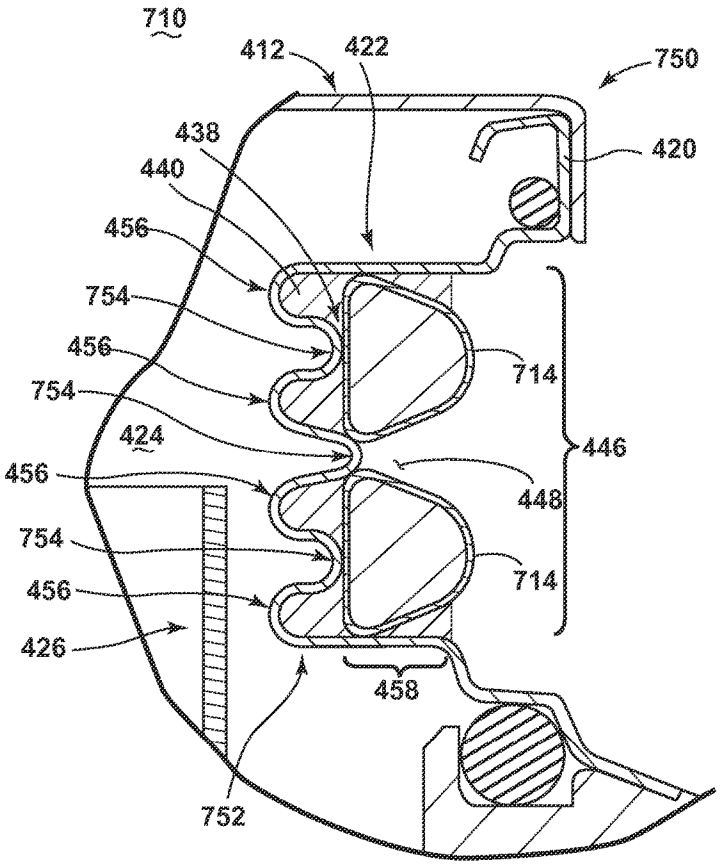
FIG. 11 is a view similar to FIGS. 8-10 and illustrates an alternative structure for the heating element and casing.

FIG. 11 illustrates a pump assembly 710 according to yet another embodiment of the invention. The pump assembly 710 may be similar to the pump assemblies 410, 510, and 610; therefore, like parts will be identified with like numerals increased by 300, with it being understood that the description of the like parts of the pump assembly 410 applies to the pump assembly 710, unless otherwise noted. One difference is that the heating element 714 has a triangular-like cross section, wherein the triangular tip away from the convolutions 752 is rounded. Additionally, the convolutions 752 of the heat transfer area 750 are shown conforming to the alternative heating element 714 cross sectional shape.

Many other possible embodiments and configurations in addition to that shown in the above figures are contemplated by the present disclosure. For example, one embodiment of the invention contemplates a pump assembly having a non-centrifugal pump. Another embodiment of the invention may position the heating element such that there may be no gap between the dually wound elements. Furthermore, while the inlet opening may be provided in an end of the housing opposite the impeller, and the projection may be provided at the end of the housing, alternate configurations are envisioned wherein the position of various components are rearranged so long as the liquid path interacts with the projection so the described heating may occur. Additionally, the design and placement of the various components may be rearranged such that a number of different in-line configurations could be realized.

Embodiments described above provide for a variety of benefits including enhanced filtration such that soil is filtered from the liquid and not re-deposited on dishes and allow for cleaning of the rotating filter throughout the life of the dishwasher and this maximizes the performance of the dishwasher. Thus, such embodiments require less user maintenance than required by typical dishwashers. Regardless of whether a filter is included, calcium precipitates out of water at higher temperatures, creating water scale at or near the heating element in a pump. One advantage that may be realized in the above embodiments is that the above described embodiments allow for an elongated heating element surface area, and thus generating heat over a larger heat transfer area. This operatively reducing the watt density of the heat transfer area by distributing a known wattage over a longer length, which in turn, reduces calcium precipitation while heating the liquid. Another advantage of the above embodiments may be that the effective heat transfer from the heating element to the liquid may be further increased using the optional heat-transferring brazing material. Yet another advantage of the above embodiments may be that the increased heat transfer surface area of the plurality of convolutions further increases the effective heat transfer of the heating element and brazing material, and further reduces the watt density of the heating element. Even yet another advantage of the above embodiments may be that any calcium or water scale that does develop at the heat transfer area will harden and break off during the thermal expansion and contraction at the convex surfaces of the peaks and valleys of the convolutions. In another advantage of the above described embodiments, the projection's depth into the volute chamber increases the heat transfer area, further reducing the watt density of the heating element.

To the extent not already described, the different features and structures of the various embodiments may be used in combination with each other as desired. That one feature may not be illustrated in all of the embodiments may not be meant to be construed that it may not be, but may be done for brevity of description. Thus, the various features of the different embodiments may be mixed and matched as desired to form new embodiments, whether or not the new embodiments are expressly described. All combinations or permutations of features described herein are covered by this disclosure. The primary differences among the exemplary embodiments relate to a pump assembly, and these features may be combined in any suitable manner to modify the above described embodiments and create other embodiments.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A pump and filter assembly, comprising:

an impeller, a housing defining an interior and exterior and where the housing includes an end plate defining an end of the housing and the end plate further defining a channel that extends inwardly towards the interior, and an inlet opening provided within the end plate; and a filter having an upstream surface and a downstream surface, the filter located within the interior such that liquid being pumped through the pump and filter assembly passes through the filter from the upstream surface to the downstream surface to effect a filtering of the liquid; and a heater having a heating element and where at least a portion of the heating element is received exteriorly of the housing and within the channel such that the heating element is located on the end of the housing adjacent the inlet opening of the housing and the heater encircles at least a portion of the inlet opening of the housing and where the heater is configured to heat liquid that has passed through the inlet opening of the housing.

2. The pump and filter assembly of claim 1 wherein the filter is a rotating filter.

3. The pump and filter assembly of claim 2 wherein the impeller is operably coupled to the filter to effect rotation of the filter.

4. The pump and filter assembly of claim 1 wherein the filter is a hollow filter having a filter exterior and a filter interior and the filter exterior defines the upstream surface and the filter interior defines the downstream surface.

5. The pump and filter assembly of claim 1 wherein the heating element of the heater is a tubular heating element.

6. The pump and filter assembly of claim 1 wherein the channel further comprises convolutions extending from a portion of the end plate into the housing.

7. The pump and filter assembly of claim 6 wherein the convolutions comprise peaks and valleys.

8. The pump and filter assembly of claim 7 wherein the peaks define at least a portion of a heater seat on which at least a portion of the heating element rests.

9. The pump and filter assembly of claim 1 wherein the channel conforms to a shape of the heating element.

10. The pump and filter assembly of claim 1 wherein the end plate is operably coupled to the housing to locate the heater adjacent the inlet opening.

11. The pump and filter assembly of claim 1 wherein the end plate comprises a projection extending toward the filter and the projection defines the channel.

12. The pump and filter assembly of claim 1 wherein the heater comprises at least one of a rectilinear and a trapezoidal cross section.

13. The pump and filter assembly of claim 1 wherein the heater comprises multiple concentric coils.

14. The pump and filter assembly of claim 1 wherein the heater encircles the inlet opening.

15. The pump and filter assembly of claim 1 wherein the heater is upstream of the filter.

16. A pump and filter assembly, comprising:

a housing defining an interior and having an end plate that defines an end of the housing, the end plate also defines a channel with convolutions extending from a portion of the end plate into the housing, an inlet opening is provided at the end of the housing;

a filter having an upstream surface and a downstream surface and located within the interior such that liquid passes through the filter from the upstream surface to the downstream surface to effect a filtering of the liquid; and a heater having a heating element located on the end of the housing adjacent the inlet opening of the housing and configured to heat liquid that has passed through the inlet opening of the housing and where at least a portion of the heating element is received within the channel.

17. The pump and filter assembly of claim 16 wherein the heater encircles at least a portion of the inlet opening.

18. The pump and filter assembly of claim 16 wherein the filter is a rotating filter.

19. The pump and filter assembly of claim 18, further comprising an impeller located within the interior and wherein the impeller is operably coupled to the filter to effect rotation of the filter.

20. The pump and filter assembly of claim 19 wherein the filter is a hollow filter having a filter exterior and a filter interior and the filter exterior defines the upstream surface and the filter interior defines the downstream surface.

* * * * *